US006605011B1

(12) United States Patent
Yamamoto et al.

(10) Patent No.: US 6,605,011 B1
(45) Date of Patent: Aug. 12, 2003

(54) GAME MACHINE

(75) Inventors: Hideaki Yamamoto, Ota-ku (JP); Genzou Watanabe, Ota-ku (JP)

(73) Assignee: Namco Ltd., Tokyo (JP)

( * ) Notice: Subject to any disclaimer, the term of this patent is extended or adjusted under 35 U.S.C. 154(b) by 0 days.

(21) Appl. No.: 09/807,752

(22) PCT Filed: Aug. 25, 2000

(86) PCT No.: PCT/JP00/05745

§ 371 (c)(1),
(2), (4) Date: May 14, 2001

(30) Foreign Application Priority Data

Aug. 25, 1999 (JP) ..... 11-238074

(51) Int. Cl.[7] ..... A63B 69/00
(52) U.S. Cl. ..... 473/455; 473/456; 473/463
(58) Field of Search ..... 473/455, 456, 473/457, 451, 453, 415, 417, 422, 423, 427, 468

(56) References Cited

U.S. PATENT DOCUMENTS 4,915,384 A * 4/1990 Bear
5,401,018 A * 3/1995 Kelly et al.
5,443,260 A * 8/1995 Stewart et al.
5,639,084 A * 6/1997 Kawasaki ..... 473/451 X

FOREIGN PATENT DOCUMENTS

| | | |
|---|---|---|
| JP | A 9-47534 | 2/1997 |
| JP | A 9-84914 | 3/1997 |
| JP | 3051647 | 6/1998 |
| JP | 3060107 | 4/1999 |
| JP | A 11-285552 | 10/1999 |

* cited by examiner

*Primary Examiner*—Chen Wen Jiang
(74) *Attorney, Agent, or Firm*—Oliff & Berridge, PLC

(57) ABSTRACT

A game machine that enables the playing of an enjoyable ball game within a limited space, particularly a baseball-related game. This game machine comprises a target (10) on which is displayed wording such as "single base hit", a ball supply section (20*a*), a home base (112*a*) for a right-handed batter and a home base (112*b*) for a left-handed batter provided in a batting area (110), and a batter's box (114) therebetween. This game machine uses a predetermined evaluation means to detect whether a ball (200) hit by a player (300) using a bat (210) has hit the target (10), and displays an evaluation result on an on-base status display section (60*a*) and a numerical value display section (60*b*).

5 Claims, 4 Drawing Sheets

GAME MACHINE

TECHNICAL FIELD

The present invention relates to a game machine for a ball game and, in particular, to a game machine for a baseball-related game.

BACKGROUND ART

When a game machine that enables a ball game such as a baseball or soccer game is provided in today's city environment, the area in which the game machine is installed is limited. For that reason, it is important to provide a game machine that can enable an agreeable real-life ball game within a limited area, with no feeling of strangeness.

For baseball there are batting centers and for tennis there are tennis courts. However, games like these that approximate to real-life ball games lack interest so that most games centers prefer not to provide facilities that require a large dedicated area, such as batting centers or tennis courts, for business reasons.

That is why, if a baseball-related game is provided in a conventional game center, by way of example, it is a baseball-related game in which a predetermined batting area is provided and the area from the ball supply device to the batting area is bounded by a cage to ensure safety.

However, baseball-related games that are provided in batting centers and conventional game centers simply enable players to hit balls, so they lack interest.

A particular problem lies in the fact that it is necessary to provide batting areas for both right-handed players and left-handed players in a ball game that involves batting, such as baseball, which increases the area required therefor. It is also necessary to provide an interesting game, even when the necessary area is small.

DISCLOSURE OF THE INVENTION

The present invention was devised in the light of the above described problems and has as an objective thereof the provision of a game machine that enables an enjoyable ball game within a limited space, particularly a baseball-related game.

(1) In order to solve the above described problems, according to one aspect of the present invention, there is provided a game machine for a ball game comprising:

- a ball supply means which supplies a ball to a batting area in which a player bats;
- a plurality of targets disposed in a direction of batting from the batting area;
- detection means which detects a hit on the targets by a ball struck by the player; and
- evaluation means which calculates a game result based on a result of the detection.

According to another aspect of the invention, there is provided a game machine for a ball game, comprising:

- a ball supply device which supplies a ball to a batting area in which a player bats;
- a plurality of targets disposed in a direction of batting from the batting area;
- a sensor which detects a hit on the targets by a ball struck by the player; and
- an evaluation circuit which calculates a game result based on a result of the detection.

The present invention makes it possible for a player to enjoy a game of hitting supplied balls to hit targets. With a baseball-related game, by way of example, it is necessary to provide fencing and large-scale facilities to approximate to a real-life baseball-related game, but the provision of targets makes it possible to enjoy a sufficiently interesting game even when the distance from the batting area to the targets is small. This ensures that the player can enjoy an agreeable ball game within a confined space.

In addition, it makes it necessary to develop the skill of hitting targets, rather than simple full-power hitting, making it possible to provide games which are different from a batting center or the like.

Note that a ball game in this case corresponds to a game such as baseball, golf, tennis, or table-tennis. In addition, the directions of battling could be forward, obliquely, and to the sides, for example.

(2) The evaluation means may calculate a game result, based on an evaluation condition that comprises at least one of a sequence in which targets have been hit, position of a target that have been hit, sizes of targets that have been hit, the number of targets that have been hit, and the number of balls supplied.

This makes it possible to allocate different numerals to the plurality of targets, where the evaluation means calculates the game result based on the number of targets that have been hit and the number of balls supplied, by way of example. This also makes the game representation more effective. The player could declare which target he or she is aiming for, or attempt to hit all the targets with fewer balls.

(3) The game machine may further comprise means which outputs sound based on the game result calculated by the evaluation means.

This makes it possible to output sounds such as "you hit 6", "home run", or "three panels left", making the game more interesting for the player.

(4) Furthermore, batting results may be allocated to the targets; and the evaluation means may calculate the game results, based on batting results allocated to targets that have been hit by struck balls.

In this case, a battling result indicates the result of hitting a ball. In a baseball-related game, these batting results could be "single base hit", "double base hit", "triple base hit", or "home run", and in a golf game they could be "300 yards", "OB", or "bunker", by way of example. Since the game result is affected by which targets are hit, the player can become more immersed in the game by trying to hit better targets.

(5) The game machine may further comprise means which enables a player to select one game mode from a plurality of game modes having different evaluation criteria; and the evaluation means may calculate the game result based on an evaluation criterion of the game mode selected by the player.

This enables the player to select a more interesting game mode that is different from a real-life ball game, or a game mode that is similar to a real-life ball game. The player can therefore play a game that suits the player's own preferences, and be more satisfied thereby.

Note that in this case the game modes could be a mode in which the objective is to hit all of the targets with balls and a mode that conforms to the rules of a real-life ball game, by way of example.

In such a case, the evaluation criterion for the former mode could be based on at least one of the sequence in which targets have been hit, the positions of targets that have been hit, the sizes of targets that have been hit, the number of targets that have been hit, and the number of balls supplied, by way of example. The evaluation criterion for the latter mode could be based on the batting results displayed on targets that have been struck by balls that have been hit by the player.

The evaluation means could also base the calculation of the game result on the selection made by the player.

(6) The game machine may further comprise display control means which displays the game result calculated by the evaluation means in a predetermined display region.

This enables the player to verify the game result at a glance, and can thus always check his or her own status, which enables a game with an enhanced feeling of tension.

(7) The game machine may be a baseball-related game, and the display control means may display an on-base status in the display region, based on the game result calculated by the evaluation means.

This enables the player to base considerations of play on the current on-base status, enabling greater immersion in the game.

(8) The game machine may further comprise means which changes batting results allocated to the targets, based on the game result calculated by the-evaluation means.

This makes it possible to enable inexperienced players to enjoy the game, by changing the "foul ball" targets to "single base hit" in a baseball-related game, by way of example, for people who can hit only the "foul ball" targets.

(9) The game machine may further comprise a batter's box in the center of the batting area, a home base for a right-handed batter on the right side of the batter's box, and a home base for a left-handed batter on the left side of the batter's box;

wherein the ball supply means may supplies a ball to the home base for a right-handed batter when the player is right-handed or to the home base for a left-handed batter when the player is left-handed.

(10) According to still another aspect of the present invention, there is provided a game machine for a baseball-related game that involves hitting a ball supplied from a predetermined ball supply device, the game machine comprising:

a batter's box in the center of a batting area, a home base for a right-handed batter on the right side of the batter's box, and a home base for a left-handed batter on the left side of the batter's box.

This aspect of the present invention makes it possible for both right-handed and left-handed batters to enjoy the game in a similar fashion, even in a limited space. In general, a baseball-related game machine has either a home base for right-handed batters or two batter's boxes disposed on either side of a central home base. The former case is unfair on left-handed batters and the later case increases the space necessary therefor, because it is also necessary to provide space on both sides for follow-through after the bat has been swung.

The configuration of this aspect of the present invention makes it possible to use the follow-through space provided for right-handed batters as the batting space for a left-handed batter, and similarly use the follow-through space provided for left-handed batters as the batting space for a right-handed batter. This makes it possible to play a baseball-related game with a smaller batting area, and thus play this baseball-related game even in locations where it is not possible to ensure a sufficiently large area therefor, such as in cities.

(11) The ball supply device may supply a ball to the home base for a right-handed batter when a player is right-handed or to the home base for a left-handed batter when the player is left-handed.

This makes it possible for both left-handers and right-handers to enjoy a fair game in a limited space.

(12) The ball supply device may be configured as a single ball supply device that supplies a ball either to the home base for a right-handed batter or to the home base for a left-handed batter as specified by a player selection.

This makes it possible to create a baseball-related game within a smaller space than that required if a plurality of ball supply devices are provided.

(13) The ball supply device may include a ball supply device for a right-handed batter that supplies a ball to the home base for a right-handed batter and a ball supply device for a left-handed batter that supplies a ball to the home base for a left-handed batter.

This makes it possible to create a baseball-related game that has a simpler configuration than one in which a single ball supply device is provided and the direction in which balls are supplied varies in accordance with the batter.

BEST MODE FOR CARRYING OUT THE INVENTION

A game machine for providing a baseball-related game, to which an embodiment of the present invention is applied, is described below with reference to the accompanying figures.

Figure 1:
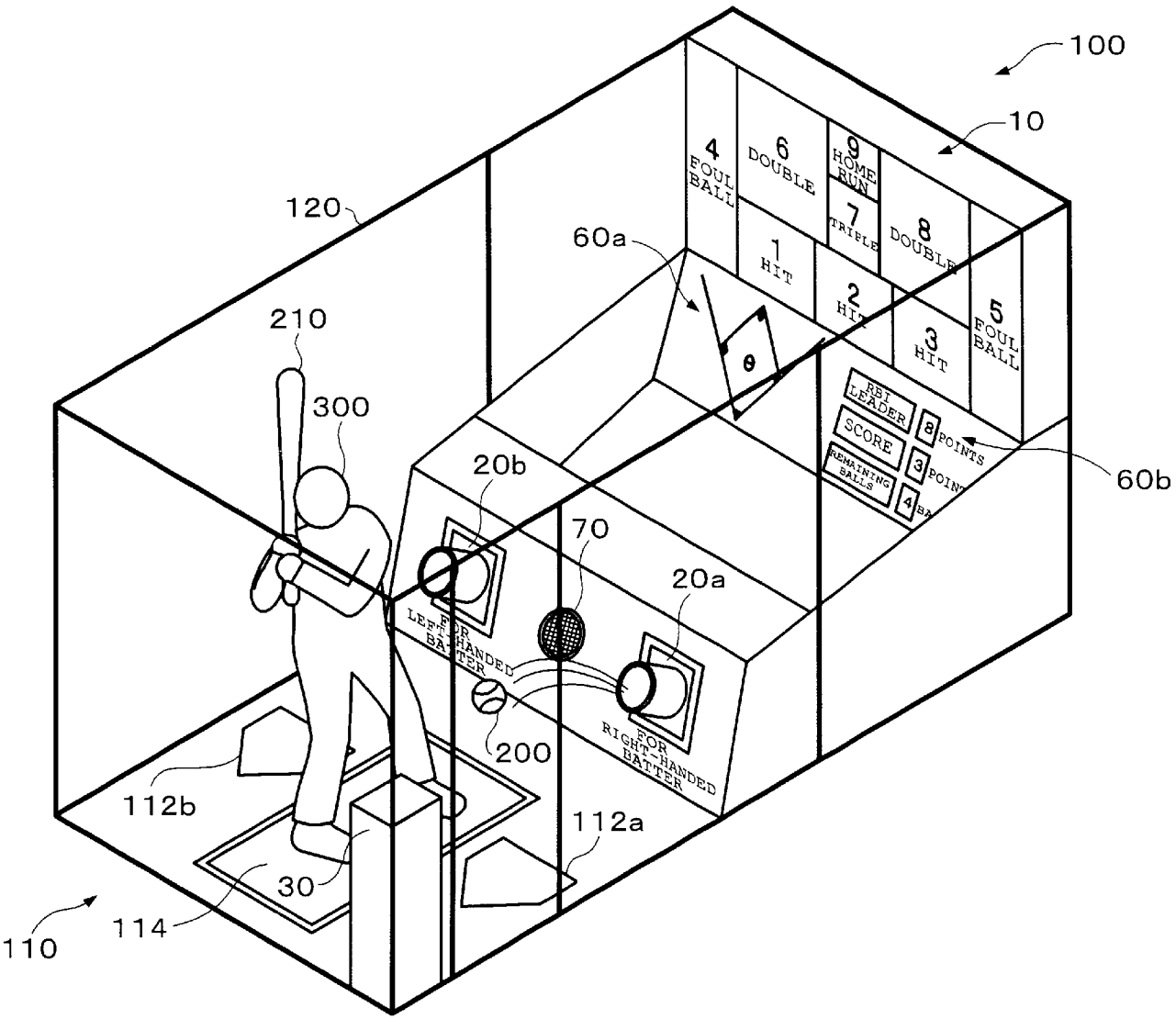
FIG. 1 is a perspective view of a game machine in accordance with a typical embodiment of the present invention.

A perspective view of a game machine 100 relating to an example of this embodiment of the present invention is shown in FIG. 1.

A player 300 uses a bat 210 to hit a ball 200 that has been tossed from a ball supply section 20*a* or a ball supply section 20*b*, to hit a desired panel of a panel section 10 that is a target disposed in front of a batting area 110.

Different numerals from 1 to 9 and different batting results are allocated to each of nine panels of the panel section 10. For example, "single base hit" is allocated as the batting result for the panel marked "1" and "home run" is allocated as the batting result for the panel marked "9".

The player 300 enters the batting area 110, inserts a coin into a predetermined location, presses a button of a selection section 30 to select one game mode from a plurality of game modes with different evaluation criteria, then selects a batting position.

Examples of these game modes include a "nine-target mode" in which the objective is to hit all of the nine panels with balls and an "actual-play mode" in which the objective is to obtain the best possible batting result.

The player selects either "right batting position" or "left batting position" as the batting position, so that a right-handed player would select the right batting position, by way of example. The description below relates to a case in which the player 300 has selected the right batting position.

The description first deals with an example in which the player 300 has selected "nine-target mode".

All the balls 200 (12 of them) from the ball supply section 20*a* for the right batting position are tossed onto a home base

112*a* for the right batting position. As shown in FIG. 1, the home base 112*a* for the right batting position is provided on the right side of a batter's box 114 in which the player 300 is positioned and a home base 112*b* for the left batting position is provided on the left side of the batter's box 114.

This makes it possible to use the follow-through space provided for right-handed batters as the batting space for a left-handed batter, and similarly used the follow-through space provided for left-handed batters as the batting space for a right-handed batter. It is therefore possible to play a baseball-related game in a smaller space so that the baseball-related game can be played even in locations where it is impossible to guarantee the necessary area for such a game, such as in a city.

The location to which each ball 200 is tossed is on the home base 112*a* for the right batting position if the player 300 selected the right batting position or the home base 112*b* for the left batting position is the player 300 selected the left batting position. This makes it possible for both left- and right-handed players to enjoy a fair game, even in a limited space.

The player 300 strikes the tossed ball 200 with the bat 210 to hit the panel. If the ball 200 struck by the bat 210 hits panel "1", by way of example, the sound "you hit 1" is output from a sound output section 70 and panel "1" lights up. This enables a more interesting baseball-related game, by enhancing the game with sounds and displays. Note that it is also possible to have a configuration in which all of the panels are lit at game start, and panels that have been hit by the balls 200 go dark.

In addition, the sound output section 70 also outputs "Three panels left" when six panels have been hit, then "Perfect!" when all nine panels have been hit, whereupon all nine panels flash. The game machine 100 is configured in such a manner to give a higher evaluation when the player has achieved a perfect score, and when that score is achieved with a smaller supply of the balls 200.

If a perfect score has been achieved, the number of balls that achieved that score appears in a predetermined status display section as a high-score display. Note that there are boundary lines on the panel. The game machine 100 could be configured to enable the possibility of a perfect score with fewer than nine balls, by performing decision processing that determines that, if one of the balls 200 hits a boundary line, all of the panels touching that boundary line have been hit.

The description now turns to "actual-play mode", which is another mode of play.

This "actual-play mode" differs from "nine-target mode" in that the evaluation is based on the batting results allocated to the panels.

Figure 2:
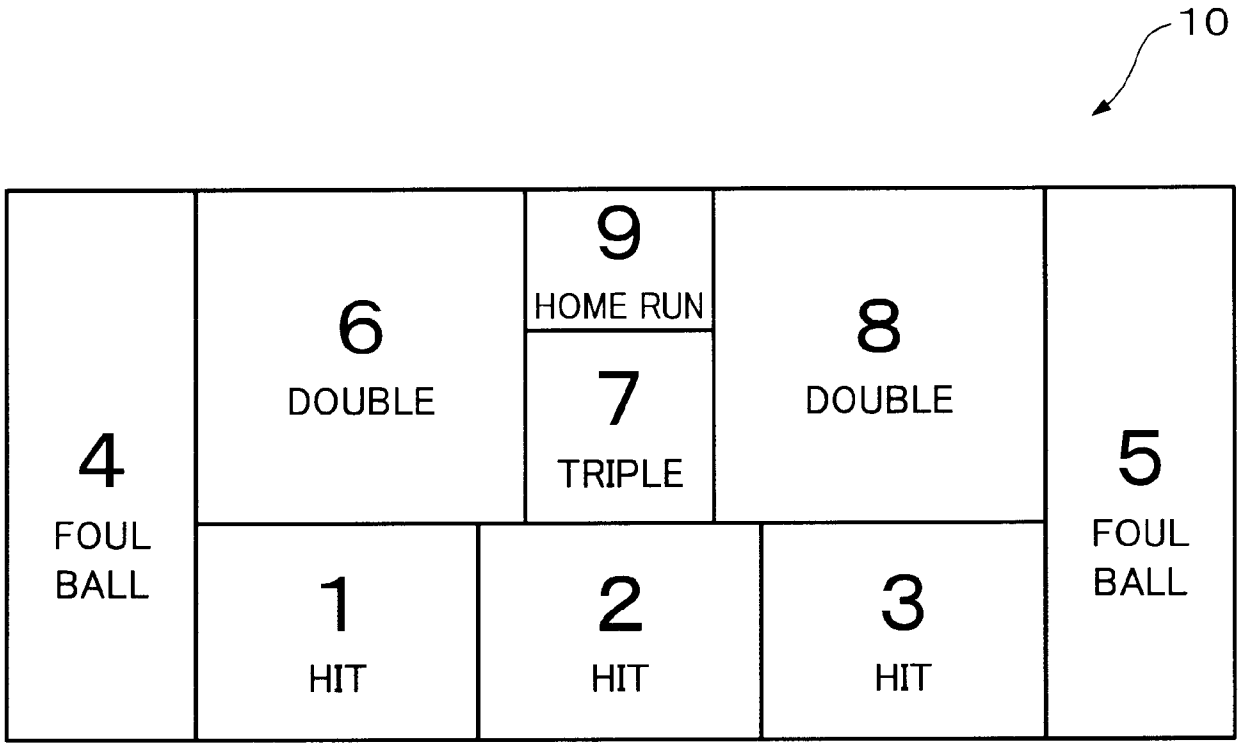
FIG. 2 shows an example of a target pattern.

An example of a target pattern is shown in FIG. 2.

As shown in FIG. 2, not only numerals are allocated to the nine panels, but also batting results such as "single base hit" and "home run" are printed thereon. In addition, the panel sizes are not the same, so that larger batting results such as "home run" and "triple base hit" have smaller panels and fewer panels, whereas smaller batting results such as "single base hit" and "foul ball" have larger panels and more panels. This makes it difficult to obtain a good batting result, increasing the competitiveness of the game.

If the ball 200 hit by the player 300 hits in the middle of a panel allocated to "single base hit", by way of example, the hit panel lights briefly and the sound "hit to center field" is output from the sound output section 70.

In "actual-play mode", the status of players on bases is displayed by an on-base status display section 60*a* whereas the number of balls remaining and the score status are displayed by a numerical value display section 60*b*.

The first base indication of the on-base status display section 60*a* could be lit by hitting the "single base hit" panel with the ball 200, by way of example. If the "double base hit" panel is hit after the "single base hit" panel, both second base and third base of the on-base status display section 60*a* light up. In this manner, the player 300 can experience fun that is similar to that of a real game of baseball, by this update of the status display in real time in accordance with the batting results.

The game ends when a predetermined number of the balls 200 have been supplied to the player 300. At that point, the score is compared with a previous high score and, if it exceeds that high score, the high-score display is updated.

Note that the game machine 100 is protected by a cage 120 and the cage 120 is covered with netting to prevent the hit balls from going outside the game machine, thus ensuring safety.

The description now turns to function blocks of the game machine 100 that enable the implementation of the functions described above.

Figure 3:
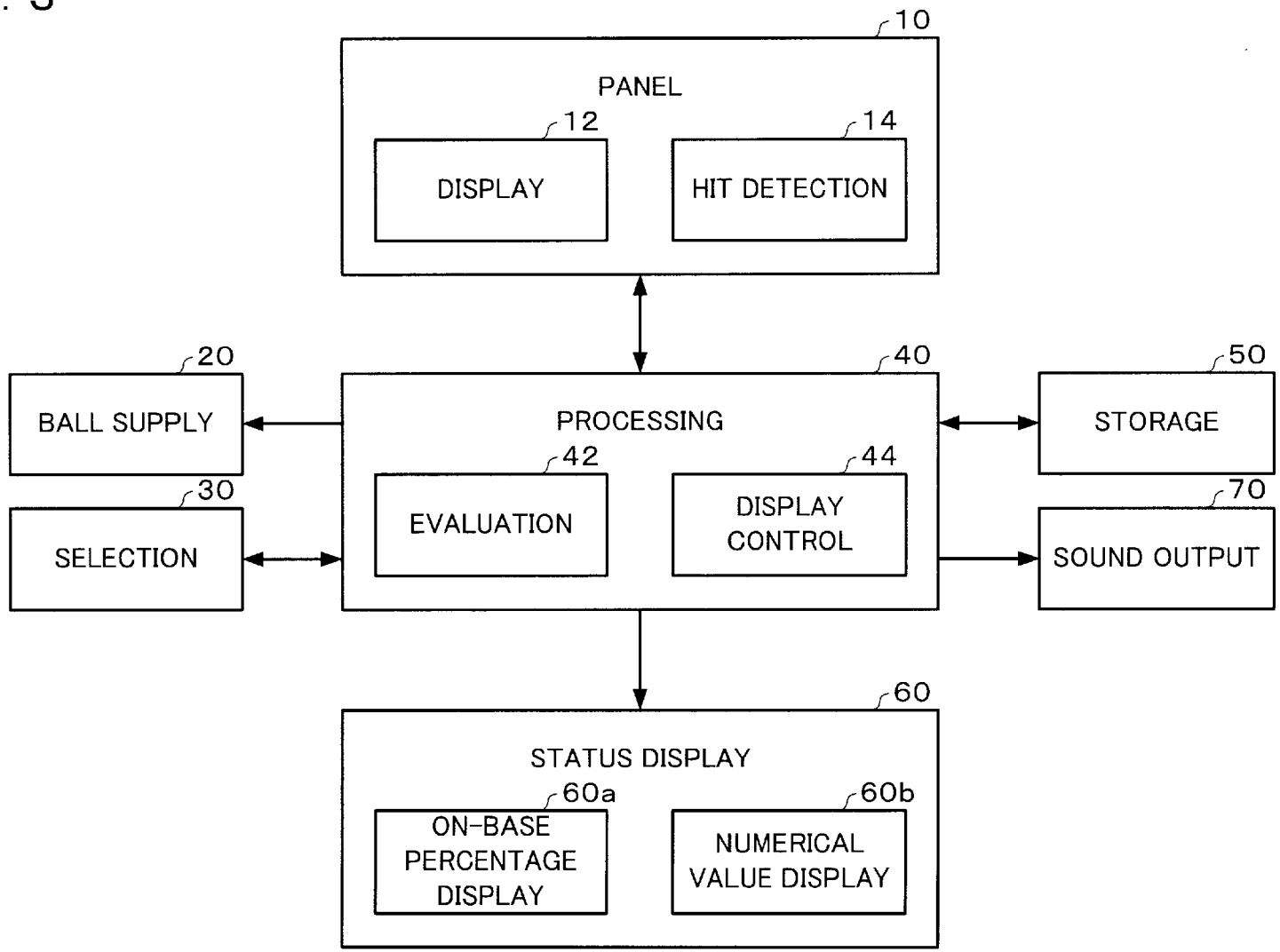
FIG. 3 is a function block diagram of a game machine in accordance with one embodiment of the present invention.

A function block diagram of the game machine 100 relating to this example of the present invention is shown in FIG. 3.

The game machine 100 comprises a ball supply section 20, the selection section 30 enabling the player to select a game mode and batting position, the panel section 10, a processing section 40 for performing various types of game processing, status display section 60 that displays the on-base status, etc., a storage section 50, and the sound output section 70.

The ball supply section 20 comprises the ball supply section 20*a* for the right batting position and the ball supply section 20*b* for the left batting position.

The panel section 10 comprises a display section 12 and a hit detection section 14 that are provided for each panel. Panels are lit by the display section 12 and whether or not the ball 200 has hit a panel is detected by the hit detection section 14. More specifically, the functions of the display section 12 can be implemented by means such as LEDs or lamps and the functions of the hit detection section 14 can be implemented by sensors that detect a touch on a panel, by way of example.

The processing section 40 comprises an evaluation section 42, which performs an evaluation based on factors such as the batting results allocated to the panels and the number of balls supplied, and a display control section 44, which controls the displays on the display section 12 and the status display section 60 in accordance with the hits and evaluation. More specifically, the functions of the processing section 40 having the evaluation section 42 and the display control section 44 can be implemented by a CPU that can execute a program, or circuitry.

The status display section 60 comprises the on-base status display section 60*a* and the numerical value display section 60*b*, and is controlled by the display control section 44. The on-base status display section 60*a* displays the status of players on bases and the numerical value display section 60*b* displays numerical values indicating the high score, the current score, and the number of balls remaining. More specifically, the functions of the status display section 60 can be implemented by means such as LEDs or lamps.

The storage section 50 stores data such as high-score data, status data, and a game program sent from the processing section 40. More specifically, the storage section 50 can be implemented by means such as RAM.

The sound output section 70 is configured to output sounds in accordance with the evaluation of the evaluation section 42. More specifically, the functions of the sound output section 70 can be implemented by means such as a sound generation IC and speakers.

The functions of the selection section 30 can be implemented by means such as buttons or a joystick.

Note that the bat 210 is a plastic bat and the balls 200 are also made from a soft material, making them light and easy to handle, and also safe from the danger of injury.

The processing sequence of the baseball-related game implemented by the above components will now be described.

Figure 4:
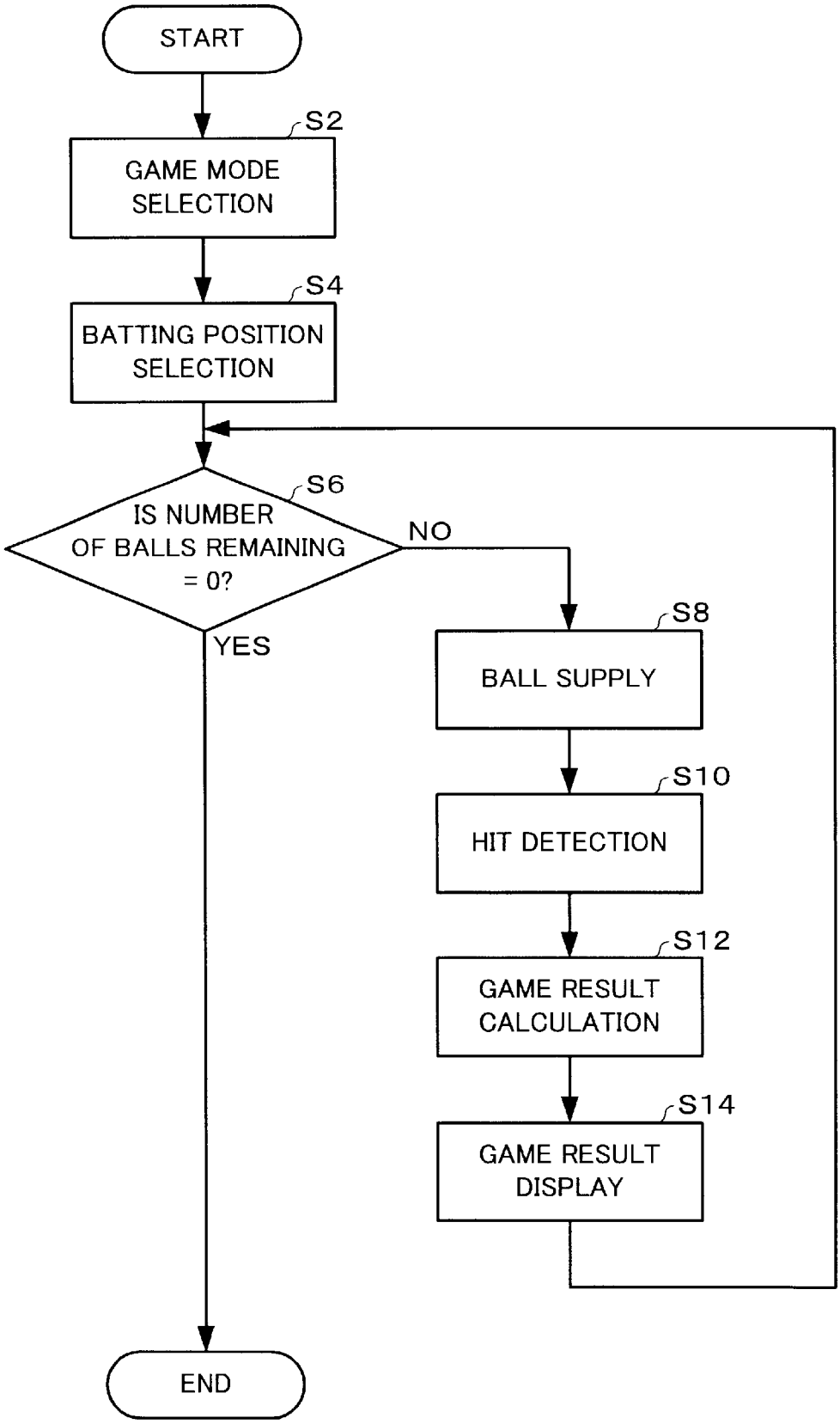
FIG. 4 is a flowchart of the processing sequence of a game machine for a baseball-related game in accordance with one embodiment of the present invention.

A flowchart of the processing sequence of the baseball-related game in accordance with this embodiment of the present invention is shown in FIG. 4.

As described above, the player 300 first inserts a coin then uses the selection section 30 to select a game mode (step 2).

This determines whether "nine-target mode" or "actual-play mode" is selected, and the evaluation section 42 performs evaluation in accordance with that mode.

The player 300 then uses the selection section 30 to select a batting position. The determination of the batting position governs whether the processing section 40 supplies the balls 200 from the ball supply section 20*a* or from the ball supply section 20*b*.

In the initial state, the status data stored in the storage section 50 is such that the number of balls remaining is 12, there are no players on the bases, the score is zero, and the high score is the highest score obtained up to the start of that game.

The game processing is performed while the number of balls remaining is not zero (step 6).

If the right batting position has been selected by the player 300, the ball supply section 20*a* supplies the balls 200 to the player 300 (step 8). The player 300 hits the supplied balls 200 with the bat 210.

The hit detection section 14 detects whether or not each ball 200 by the player 300 strikes a panel (step 10). If the hit detection section 14 has detected a hit, it sends a detection signal to the evaluation section 42.

The evaluation section 42 calculates the game result, based on the current status data stored in the storage section 50 and the hit detection result (step 12). After calculating the game result, the evaluation section 42 updates the status data within the storage section 50.

The display control section 44 controls the displays of the status display section 60 and the display section 12 of the panel section 10, based on the calculated game result.

This ensures that the display section 12 lights up the panel that the ball 200 has hit and displays the game result after changing the on-base status of the on-base status display section 60*a* and the score of the numerical value display section 60*b* (step 14).

Simultaneously therewith, the processing section 40 takes predetermined sound data that is stored in the storage section 50 and transfers it to the sound output section 70, and the sound output section 70 outputs sound such as "center-front hit".

For each of the balls 200 supplied, the processing section 40 decrements the count of remaining balls comprised within the status data of the storage section 50 and the display control section 44 updates the display of the number of balls remaining on the numerical value display section 60*b*. The game ends when the number of balls remaining reaches zero (step 6).

At this point, the evaluation section 42 compares the obtained score and the number of balls required to reach a perfect score with the status data that is stored in the storage section 50. If the high score is exceeded, the evaluation section 42 updates the high-score data and the display control section 44 controls the display section 12 to display the new high score on the numerical value display section 60*b*.

In this manner, this embodiment of the present invention enables the player 300 to enjoy a game of hitting the supplied balls 200 to strike targets. Although it would be necessary to provide fencing and large-scale facilities to approximate a real-life baseball-related game, the provision of targets makes it possible to enjoy a sufficiently interesting game even when the distance from the batting area to the targets is small. This makes it possible for the player 300 to enjoy a game that provides an agreeable ball game within a restricted space.

In addition, it is necessary to employ skill to hit targets, in comparison to a game that requires nothing but full-power hitting, making it possible to provide different amusements within a batting center.

Furthermore, the display of batting results such as "single base hit", "double base hit", "triple base hit", and "home run" ensures that the game result is changed by the player hitting a target, enabling the playing of a game wherein the player strives to hit better targets.

The ability to select game modes makes it possible for the player 300 to select a more interesting mode that differs from a real-life ball game or a mode that is close to a real-life ball game, so that the player can play a game that matches his or her own preferences, which is more satisfying.

The provision of the status display section 60 ensures that the player 300 can verify the game result at a glance, and can thus always check his or her own status, which enables a game with an enhanced feeling of tension.

In particular, the display of the on-base status enables the player 300 to base considerations of play on the current on-base status, enabling greater immersion in the game.

The above described configuration, in which the batter's box 114 is provided in the middle, the home base 112*a* for the right batting position is provided on the right, and the home base 112*b* for the left batting position is provided on the left, makes it possible to play a baseball-related game in a restricted space.

Note that the applications of the present invention are not limited to the embodiment described above.

For example, the present invention can be applied to ball games other that baseball-related games, such as golf, tennis, or table-tennis.

In the above embodiment, the configuration is such that the batting results allocated to the targets are fixed and the batting results are displayed on the targets, by way of example, but the game machine could also have a configuration comprising means for displaying different batting results allocated to the targets, based on a game result calculated by the evaluation section 42.

This makes it possible to enable inexperienced players to enjoy the game, by changing the "foul ball" targets to "single base hit" in a baseball-related game, by way of example, for people who can hit only the "foul ball" targets.

Similarly, the above embodiment was described as being provided with two dedicated ball supply sections 20*a* and 20*b* for the left and right batting positions, by way of example, but it could also be configured to have a single ball supply section that supplies balls to either the home base for right-handed batters or the home base for left-handed batters.

This makes it possible to create a baseball-related game within a smaller space than that required if a plurality of ball supply devices are provided.

Note that if the two ball supply sections 20*a* and 20*b* are provided for the left and right batting positions, this makes it possible to create a baseball-related game that has a simpler configuration than one in which a single ball supply device is provided and the direction in which balls are supplied varies in accordance with the batter.

In addition, the method of evaluating the game result could be based on evaluation conditions that comprise at least one of the sequence in which targets have been hit, the positions of targets that have been hit, and the sizes of targets that have been hit, other than the above described batting result, number of balls supplied, and number of targets that have been hit, and a game mode based on such evaluation criteria could also be provided.

Note that it is also possible to provide objects other than panels as the targets, such as boats, containers, dolls, or holes, as appropriate. The targets could also be provided obliquely or to the sides; not just in front of the game machine.

What is claimed is:

1. A game machine for playing a ball game within a limited space, comprising:

a ball supply means which tosses a ball into a batting area in which a player bats;

a plurality of targets disposed in a direction of batting from the batting area;

detection means which detects a hit on the targets by a ball struck by the player; and evaluation means which calculates a game result based on a result of detecting hits on the targets and an evaluation criteria for providing an improved game result when the targets are hit according to a given rule; and a batter's box in the center of the batting area, a home base for a right-handed batter on the right side of the batter's box, and a home base for a left-handed batter on the left side of the batter's box;

wherein the ball supply means supplies a ball to the home base for a right-handed batter when the player is right-handed or to the home base for a left-handed batter when the player is left-handed.

2. A game machine for a baseball-related game that involves hitting a ball supplied from a predetermined ball supply device, the game machine comprising:

a batter's box in the center of a batting area, a home base for a right-handed batter on the right side of the batter's box, and a home base for a left-handed batter on the left side of the batter's box.

3. The game machine as defined in claim 2, wherein the ball supply device supplies a ball to the home base for a right-handed batter when a player is right-handed or to the home base for a left-handed batter when the player is left-handed.

4. The game machine as defined in claim 2, wherein the ball supply device is configured as a single ball supply device that supplies a ball either to the home base for a right-handed batter or to the home base for a left-handed batter as specified by a player selection.

5. The game machine as defined in claim 2, wherein the ball supply device includes a ball supply device for a right-handed batter that supplies a ball to the home base for a right-handed batter and a ball supply device for a left-handed batter that supplies a ball to the home base for a left-handed batter.

* * * * *